US005255814A

United States Patent [19]

Delagera

[11] Patent Number: 5,255,814

[45] Date of Patent: Oct. 26, 1993

[54] PAINT CAN RIM

[76] Inventor: Joseph Delagera, 139 West Ave., Hicksville, N.Y. 11801

[21] Appl. No.: 828,459

[22] Filed: Feb. 12, 1986

[51] Int. Cl.[5] ..... B65D 43/04; B65D 43/08

[52] U.S. Cl. ..... 220/352; 220/284; 220/698

[58] Field of Search ..... 220/284, 90, 352, 354

[56] References Cited

U.S. PATENT DOCUMENTS 3,791,551 2/1974 Madeira ..... 220/284

3,980,213 9/1976 Ramsay ..... 220/90

*Primary Examiner*—George T. Hall

*Attorney, Agent, or Firm*—Michael I. Kroll

[57] ABSTRACT

An improved paint can rim is provided and consists of a ring-like member, a scraping lip and a lid. The ring-like member fits on a paint can. The scraping lip has a pouring hole, is formed within the ring-like member and extends at a slight angle downwardly into the paint can to allow a paint brush to remove excess paint therefrom. The pouring hole allows the paint within the paint can to exit easily when the paint can is tipped over. The lid is removably attached to the ring-like member to seal the paint can.

6 Claims, 1 Drawing Sheet

(Separate rim and lid to replace convential cover on standard can.)

(Separate rim and lid to replace convential cover on standard can.)

(New can with built-in rim and lid.)

(New can with rim part of can, alternate construction.)

PAINT CAN RIM

BACKGROUND OF THE INVENTION

1. Field of the Invention

The instant invention relates generally to containers and more specifically it relates to an improved paint can rim.

2. Description of the Prior Art

Numerous containers have been provided in prior art that are adapted to carry liquids therein. For example, U.S. Pat. Nos. 2,928,570; 3,071,282; 4,127,211 and 4,163,374 all are illustrative of such prior art. While these units may be suitable for the particular purpose to which they address, they would not be as suitable for the purposes of the present invention as heretofore described.

SUMMARY OF THE INVENTION

A principle object of the present invention is to provide an improved paint can rim that overcomes the shortcomings of the prior art devices.

Another object is to provide an improved paint can rim that eliminates the need for the standard paint can groove and conventional cover so that once the paint can is opened and used a new lid will neatly reseal the paint can rim.

An additional object is to provide an improved paint can rim that contains a scraping lip having a pouring hole, whereby the scraping lip will allow a paint brush to remove excess paint while the pouring hole will allow paint within the paint can to exit when the paint can is tiped over.

A further object is to provide an improved paint can rim that is simple and easy to use.

A still further object is to provide an improved paint can rim that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
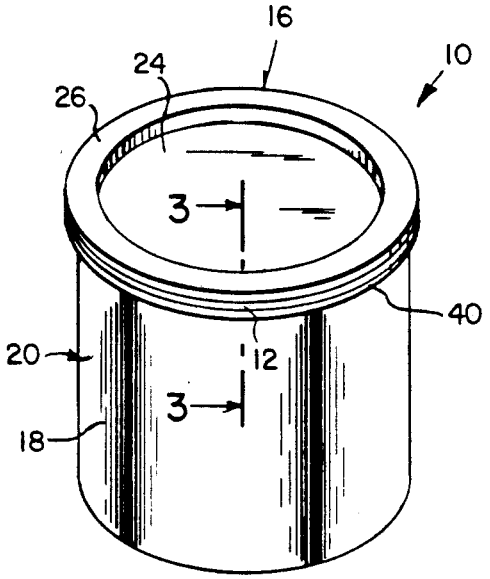
FIG. 1 is a perspective view of the invention upon a paint can.
Figure 2:
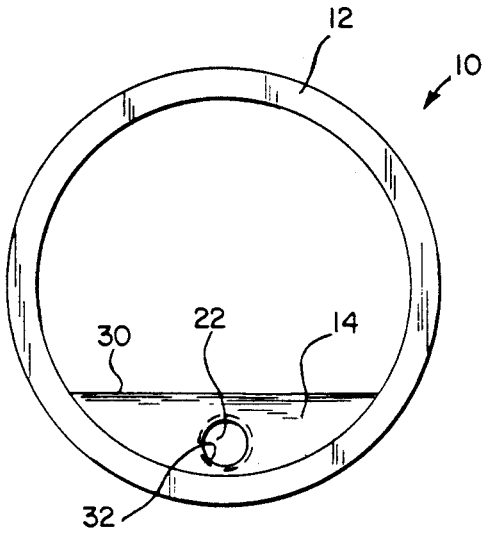
FIG. 2 is a top plan view of the rim used upon the paint can.
Figure 3:
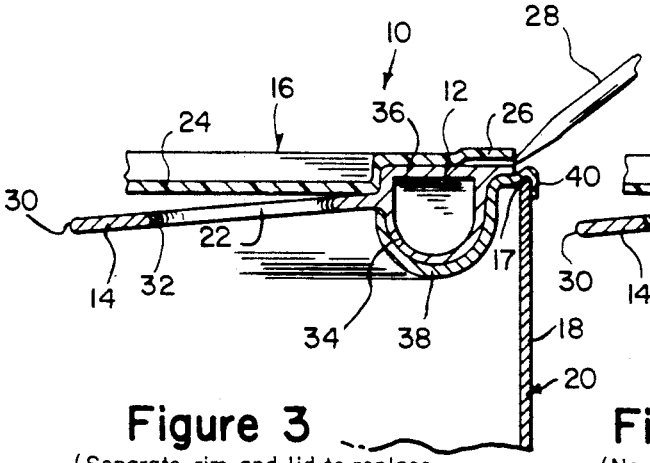
FIG. 3 is a cross sectional view taken along line 3—3 in FIG. 1 showing a separate rim and lid which replaces the conventional paint can cover.

Turning now descriptively to the drawings, in which similar reference characters denote similar elements throughout the several views, FIGS. 1 to 3 illustrate an improved paint can rim 10 which consists of a ring-like member 12, a scraping lip 14 and a lid 16.

The ring-like member 12 fits on top 17 of a body portion 18 of a paint can 20, while the scraping lip 14 has a pouring hole 22. The scraping lip 14 is formed within the ring-like member 12 and extends at a slight angle downwardly into the paint can 20 to allow a paint brush (not shown) to remove excess paint therefrom. The pouring hole 22 will allow the paint within the paint can 20 to exit easily when the paint can is tipped over.

The lid 16 has a recess portion 24 and a raised annular edge 26. The recess portion 24 is removably attached to the ring-like member 12 to seal the paint within the paint can 20. The raised annular edge 26 will allow a tool 28 such as a screwdriver or the like to be inserted for prying off the lid 16.

Edge 30 of the scraping lip 14 and edge 32 of the pouring hole are slightly rounded for a safety factor.

The ring-like member 12 further includes a downwardly extending annular rib 34 that has a hollow chamber 36 for giving extra strength to the ring-like member. The downwardly extending annular rib 34 fits within an annular flange 38 that is seamed at 40 to the top 17 of the body portion 18 of the paint can 20.

Figure 3A:
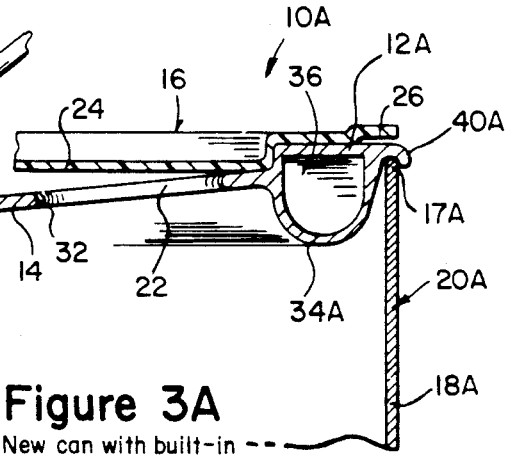
FIG. 3A is a cross sectional view similar to FIG. 3 showing a built in rim with lid.

FIG. 3A shows a modified paint can rim 10A in which the downwardly extending annular rib 34A of the ring-like member 12A is seamed at 40A directly to the top 17A of the body portion 18A of the paint can 20A.

Figure 3B:
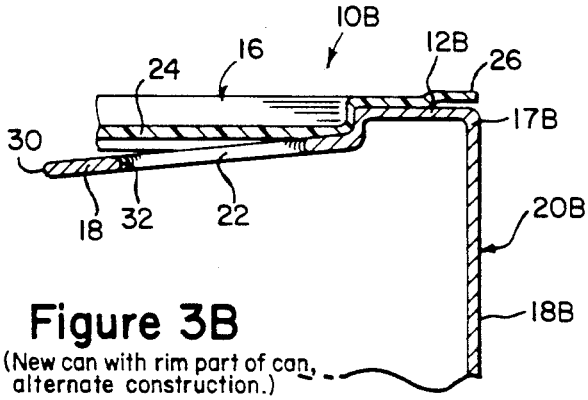
FIG. 3B is a cross sectional view similar to FIG. 3 showing the rim formed as part of the paint can with lid.

FIG. 3B shows another modified paint can rim 10B in which the ring-like member 12B is formed directly to the top 17B of the body portion 18B of the paint can 20B thus making the ring-like member 12B and the paint can 20B one complete unit.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved paint can rim which comprises:

(a) a reusable ring-like member disposable on top of a body portion of a paint can;

a scraping lip having an eccentric pouring hole and being reusable and separate from said ring-like member, said scraping lip formed within said ring-like member extending at a slight angle downwardly into said paint can to allow a paint brush to remove excess paint therefrom while said eccentric pouring hole will allow said paint within said paint can to exit easily when said paint can is tipped over; and;

(c) a lid having a recess portion and a raised annular edge and being reusable and separate from said ring-like member and said scraping lip, said recess portion being removably attached to said ring-like member to close said paint can while said raised annular edge will allow a tool such as a screwdriver or the like to be inserted for prying off said lid.

2. An improved paint can rim as recited in claim 1, wherein edge of said scraping lip and edge of said pouring hole are slightly rounded for a safety factor.

3. An improved paint can rim as recited in claim 2, wherein said ring-like member further includes a downwardly extending annular rib having a hollow chamber for giving extra strength to said ring-like member.

4. An improved paint can rim as recited in claim 3, wherein said downwardly extending annular rib fits within an annular flange that is seamed to said top of said body portion of said paint can.

5. An improved paint can rim as recited in claim 3, wherein said downwardly extending annular rib is seamed directly to said top of said body portion of said paint can.

6. An improved paint can rim as recited in claim 2, wherein said ring-like member is formed directly to said top of said body portion of said paint can thus making said ring-like member and said paint can one complete unit.

* * * * *